US011847972B2

(12) United States Patent
Lee et al.

(10) Patent No.: US 11,847,972 B2
(45) Date of Patent: Dec. 19, 2023

(54) ELECTRONIC DEVICE

(71) Applicant: SAMSUNG DISPLAY CO., LTD., Yongin-si (KR)

(72) Inventors: Dae-Sik Lee, Yongin-si (KR); Keunoh Kang, Yongin-si (KR); Sanghyun Lee, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 18/159,269

(22) Filed: Jan. 25, 2023

(65) Prior Publication Data

US 2023/0335060 A1 Oct. 19, 2023

(30) Foreign Application Priority Data

Apr. 15, 2022 (KR) ..... 10-2022-0047108

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01); *G09G 2300/0866* (2013.01); *G09G 2320/0233* (2013.01); *G09G 2320/0693* (2013.01); *G09G 2330/10* (2013.01)

(58) Field of Classification Search
CPC ..... G09G 3/3258; G09G 2300/0819; G09G 2300/0842; G09G 2300/0866; G09G 2320/0233; G09G 2320/0693; G09G 2330/10
USPC ..... 345/214
See application file for complete search history.

(56) References Cited

U.S. PATENT DOCUMENTS

| | | | | |
|---|---|---|---|---|
| 8,068,086 | B2 | 11/2011 | Moon | |
| 2007/0188430 | A1* | 8/2007 | Moon | G09G 3/3696 345/89 |
| 2008/0111812 | A1* | 5/2008 | Shirasaki | G09G 3/3291 345/212 |
| 2009/0135116 | A1* | 5/2009 | Chang | G09G 3/3696 345/87 |

(Continued)

FOREIGN PATENT DOCUMENTS

| | | |
|---|---|---|
| JP | 2011-124387 | 6/2011 |
| KR | 10-1226435 | 1/2013 |
| KR | 10-2308790 | 10/2021 |

*Primary Examiner* — Amare Mengistu
*Assistant Examiner* — Gloryvid Figueroa-Gibson
(74) *Attorney, Agent, or Firm* — CHAU & ASSOCIATES, LLC

(57) ABSTRACT

Disclosed is an electronic device, which includes a display panel, a data driving circuit, a scan driving circuit, a signal control circuit, and a power supply circuit that trims a first voltage and a second voltage based on a first control value generated based on the first voltage and the second voltage, and the power supply circuit includes a controller that generates the first control value, a sign determining circuit that determines a sign of the first control value based on the first voltage and the second voltage, a plurality of voltage generators that generate a trimming voltage of the first control value based on the first voltage and the second voltage, and a first memory that stores the first control value, and the first control value is a value for controlling the sign determining circuit and each of the plurality of voltage generators.

20 Claims, 10 Drawing Sheets

(56) References Cited

U.S. PATENT DOCUMENTS

| | | | | |
|---|---|---|---|---|
| 2011/0074762 | A1* | 3/2011 | Shirasaki | G09G 3/3225 345/76 |
| 2011/0141098 | A1* | 6/2011 | Yaguma | G09G 3/3696 345/212 |
| 2015/0091884 | A1* | 4/2015 | Yang | G09G 3/3283 345/80 |
| 2016/0012794 | A1* | 1/2016 | Takata | G09G 3/3696 345/96 |
| 2022/0208136 | A1* | 6/2022 | Tsuchi | G09G 3/3685 |

* cited by examiner

ELECTRONIC DEVICE

CROSS-REFERENCE TO RELATED APPLICATIONS

This application claims priority under 35 U.S.C. § 119 to Korean Patent Application No. 10-2022-0047108 filed on Apr. 15, 2022, in the Korean Intellectual Property Office, the disclosures of which are incorporated by reference herein in their entireties.

BACKGROUND

Embodiments of the present disclosure described herein relate to an electronic device with improved display quality.

There are being developed various electronic devices that are used in a multi-media device such as a television, a mobile phone, a tablet computer, a navigation system, and a game console.

As applications in which these electronic devices are used are diversified, the types of display panels for displaying an image displayed on electronic devices are also diversified.

Nowadays, a display panel includes a light emitting display panel. The light emitting display panel may include an organic light emitting display panel or a quantum dot light emitting display panel.

SUMMARY

Embodiments of the present disclosure provide an electronic device with improved display quality.

According to an embodiment of the present disclosure, a display panel including a plurality of scan lines, a plurality of data lines, and a plurality of pixels, and configured to display an image, a data driving circuit connected to the plurality of data lines, a scan driving circuit connected to the plurality of scan lines, a signal control circuit configured to receive input data and to control the display panel, the data driving circuit, and the scan driving circuit, and a power supply circuit configured to generate a first output voltage or a second output voltage to drive the display panel, generate a first control value based on the first output voltage or the second output voltage, and trim the first output voltage or the second output voltage based on the first control value to generate a trimmed first output voltage or a trimmed second output voltage, the second output voltage having a different level from the first output voltage, the power supply circuit including a controller configured to generate the first control value based on the first output voltage or the second output voltage, a sign determining circuit configured to determine a sign of the first control value based on the first output voltage or the second output voltage, a plurality of voltage generators configured to supply a trimming voltage of the first control value based on the first output voltage or the second output voltage to generate the trimmed first output voltage or the trimmed second output voltage, and a first memory configured to store the first control value. The first control value includes a value for controlling the sign determining circuit and a corresponding value for each of the plurality of voltage generators.

According to an embodiment, the trimming voltage may include a first trimming voltage, a second trimming voltage, and a third trimming voltage, and the plurality of voltage generators may include a first voltage generator that generates the first trimming voltage, a second voltage generator that generates the second trimming voltage, and a third voltage generator that generates the third trimming voltage.

According to an embodiment, the first trimming voltage may be 10 mV (millivolt), the second trimming voltage may be 20 mV, and the third trimming voltage may be 40 mV.

According to an embodiment, the controller may cause the power supply circuit to selectively supply at least one of the first trimming voltage, the second trimming voltage, and the third trimming voltage to generate the trimmed first output voltage or the trimmed second output voltage.

According to an embodiment, the sign determining circuit may include a first sign determiner circuit that sets a sign of the trimming voltage to a first sign, and a second sign determiner circuit that sets a sign of the trimming voltage to a second sign different from the first sign.

According to an embodiment, the control value may be a value providing whether the sign determining circuit and each of the plurality of voltage generators are turned on.

According to an embodiment, the first memory may provide the first control value to the controller when the display panel is driven.

According to an embodiment, the first memory may store the first control value in a form of a lookup table.

According to an embodiment, the power supply circuit may provide the trimmed first output voltage to the display panel and the trimmed second output voltage to the data driving circuit.

According to an embodiment, the power supply circuit may further include a second memory that stores a second control value generated based on a third output voltage and a fourth output voltage having a different level from the third output voltage, and a switching circuit that selects one of the first memory and the second memory to provide one of the first control value and the second control value to the controller.

According to an embodiment, the switching circuit may select one of the first memory and the second memory depending on a type of the display panel.

According to an embodiment, the first output voltage may have a different level than the third output voltage.

According to an embodiment, the power supply circuit may provide, when the first memory is selected, the trimmed first output voltage is provided to the display panel and the trimmed second output voltage is provided to the data driving circuit, and when the second memory is selected, a trimmed third output voltage is provided to the display panel and a trimmed fourth output voltage is provided to the data driving circuit.

According to an embodiment, each of the plurality of pixels may include a pixel driving circuit including a plurality of transistors and at least one capacitor, and a light emitting diode electrically connected to the pixel driving circuit.

According to an embodiment, the plurality of transistors may include a driving transistor driving the light emitting diode, a sensing transistor electrically connected to the driving transistor, and a switching transistor connected to one of the plurality of data lines. The trimmed first output voltage is provided to the sensing transistor, and the trimmed second output voltage is provided to the switching transistor.

According to an embodiment of the present disclosure, an electronic device includes a display panel including a plurality of scan lines, a plurality of data lines, and a plurality of pixels, and that displays an image, a data driving circuit connected to the plurality of data lines, a scan driving circuit connected to the plurality of scan lines, a signal control circuit that receives input data and controls the display panel, the data driving circuit, and the scan driving circuit, and a power supply circuit that trims a plurality of output voltages driving the display panel. The power supply circuit includes a controller that generates a plurality of control values based on the plurality of output voltages, a sign determining circuit that determines a sign of each of the plurality of control values based on the plurality of output voltages, a plurality of voltage generators that generate a trimming voltage of each of the plurality of control values based on the plurality of output voltages, a plurality of memories that respectively store the plurality of control values, and a switching circuit that selects one of the plurality of memories depending on a type of the display panel to provide a corresponding control value of the plurality of control values to the controller. Each of the plurality of control values is a value for controlling the sign determining circuit and each of the plurality of voltage generators.

According to an embodiment, the trimming voltage may include a first trimming voltage, a second trimming voltage, and a third trimming voltage, and the plurality of voltage generators may include a first voltage generator that generates the first trimming voltage, a second voltage generator that generates the second trimming voltage, and a third voltage generator that generates the third trimming voltage. The controller may cause the power supply circuit to selectively generate at least one of the first trimming voltage, the second trimming voltage, and the third trimming voltage.

According to an embodiment, the first trimming voltage may be 10 mV (millivolt), the second trimming voltage may be 20 mV, and the third trimming voltage may be 40 mV.

According to an embodiment, the sign determining circuit may include a first sign determiner that sets a sign of the trimming voltage to a first sign, and a second sign determiner that sets a sign of the trimming voltage to a second sign different from the first sign.

According to an embodiment, each of the plurality of control values may include values to determine whether the sign determining circuit and each of the plurality of voltage generators are turned on.

BRIEF DESCRIPTION OF THE FIGURES

The above and other objects and features of the present disclosure will become apparent by describing in detail embodiments thereof with reference to the accompanying drawings.

DETAILED DESCRIPTION

Figure 1:
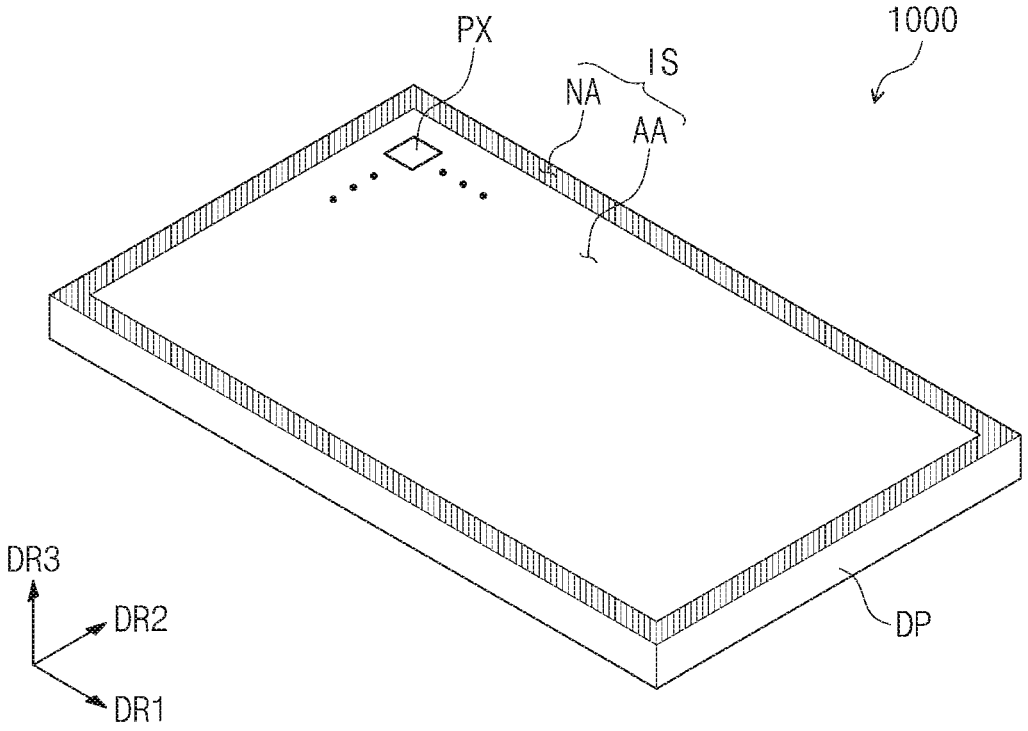
FIG. 1 is a perspective view of an electronic device, according to an embodiment of the present disclosure.

In the specification, when one component (or area, layer, part, or the like) is referred to as being "on", "connected to", or "coupled to" another component, it should be understood that the former may be directly on, connected to, or coupled to the latter, and may also be on, connected to, or coupled to the latter via a third intervening component.

Like reference numerals refer to like components. In drawings, the thickness, ratio, and dimension of components are exaggerated for effectiveness of description of technical contents. The term "and/or" includes one or more combinations of the associated listed items.

The terms "first", "second", etc. are used to describe various components, but the components are not limited by the terms. The terms are used only to differentiate one component from another component. For example, a first component may be named as a second component, and vice versa, without departing from the spirit or scope of the present disclosure. A singular form, unless otherwise stated, includes a plural form.

The terms "under", "beneath", "on", "above" are used to describe a relationship between components illustrated in a drawing. The terms are relative and are described with reference to a direction indicated in the drawing.

It will be understood that the terms "include", "comprise", "have", etc. specify the presence of features, numbers, steps, operations, elements, or components, described in the specification, or a combination thereof, not precluding the presence or additional possibility of one or more other features, numbers, steps, operations, elements, or components or a combination thereof.

Unless defined otherwise, all terms (including technical and scientific terms) used herein have the same meaning as commonly understood by one of ordinary skill in the art to which this disclosure belongs. In addition, terms such as terms defined in commonly used dictionaries should be interpreted as having a meaning consistent with the meaning in the context of the related technology, and should not be interpreted as an ideal or excessively formal meaning unless explicitly defined in the present disclosure.

Hereinafter, embodiments of the present disclosure will be described with reference to accompanying drawings.

FIG. 1 is a perspective view of an electronic device, according to an embodiment of the present disclosure.

Referring to FIG. 1, an electronic device 1000 may be configured to actually generate an image. The electronic device 1000 may be a light-emitting electronic device or a light-receiving electronic device. For example, the electronic device 1000 may be any one of an organic light emitting display device, a quantum dot light emitting display device, a micro LED display device, a nano LED display device, a liquid crystal display device, an electrophoretic display device, an electrowetting display device, and a MEMS display device, and is not particularly limited thereto.

The electronic device 1000 may include a display panel DP. The display panel DP may be used for large display panels such as televisions, monitors, and external billboards, as well as small and medium-sized display panels such as personal computers, notebook computers, personal digital terminals, car navigation units, game consoles, portable electronic devices, and cameras. In addition, these are presented only as examples, and as long as they do not deviate from the concept of the present disclosure, they may be employed in other display panels as well.

The display panel DP according to an embodiment may be a light emitting display panel, and is not particularly limited thereto. For example, the display panel DP may be an organic light emitting display panel, a quantum dot light emitting display panel, a micro LED display panel, or a nano LED display panel. Alight emitting layer of the organic light emitting display panel may include an organic light emitting material. A light emitting layer of the quantum dot light emitting display panel may include a quantum dot, a quantum rod, etc. A light emitting layer of the micro LED display panel may include micro LEDs. A light emitting layer of the nano LED display panel may include nano LEDs. Hereinafter, the display panel DP will be described as an organic light emitting display panel.

The electronic device 1000 may display an image through a display surface IS. The display surface IS may be parallel to a surface defined by a first direction DR1 and a second direction DR2. The display surface IS may include an active area AA and a peripheral area NA. A pixel PX may be disposed in the active area AA, and the pixel PX may not be disposed in the peripheral area NA. The peripheral area NA may be defined along an edge of the display surface IS. The peripheral area NA may surround the active area AA. In an embodiment of the present disclosure, the peripheral area NA may be omitted or may disposed only on one side of the active area AA.

A third direction DR3 may indicate the normal direction of the display surface IS, that is, the thickness direction of the electronic device 1000. A front surface (or upper surface) and a rear surface (or lower surface) of each of the layers or units to be described below may be divided in the third direction DR3.

Although the electronic device 1000 having the display surface IS of a flat type is illustrated in an embodiment of the present disclosure, the present disclosure is not limited thereto. The electronic device 1000 may include a curved display surface or a three-dimensional display surface. The three-dimensional display surface may include a plurality of display areas indicating different directions.

Figure 2:
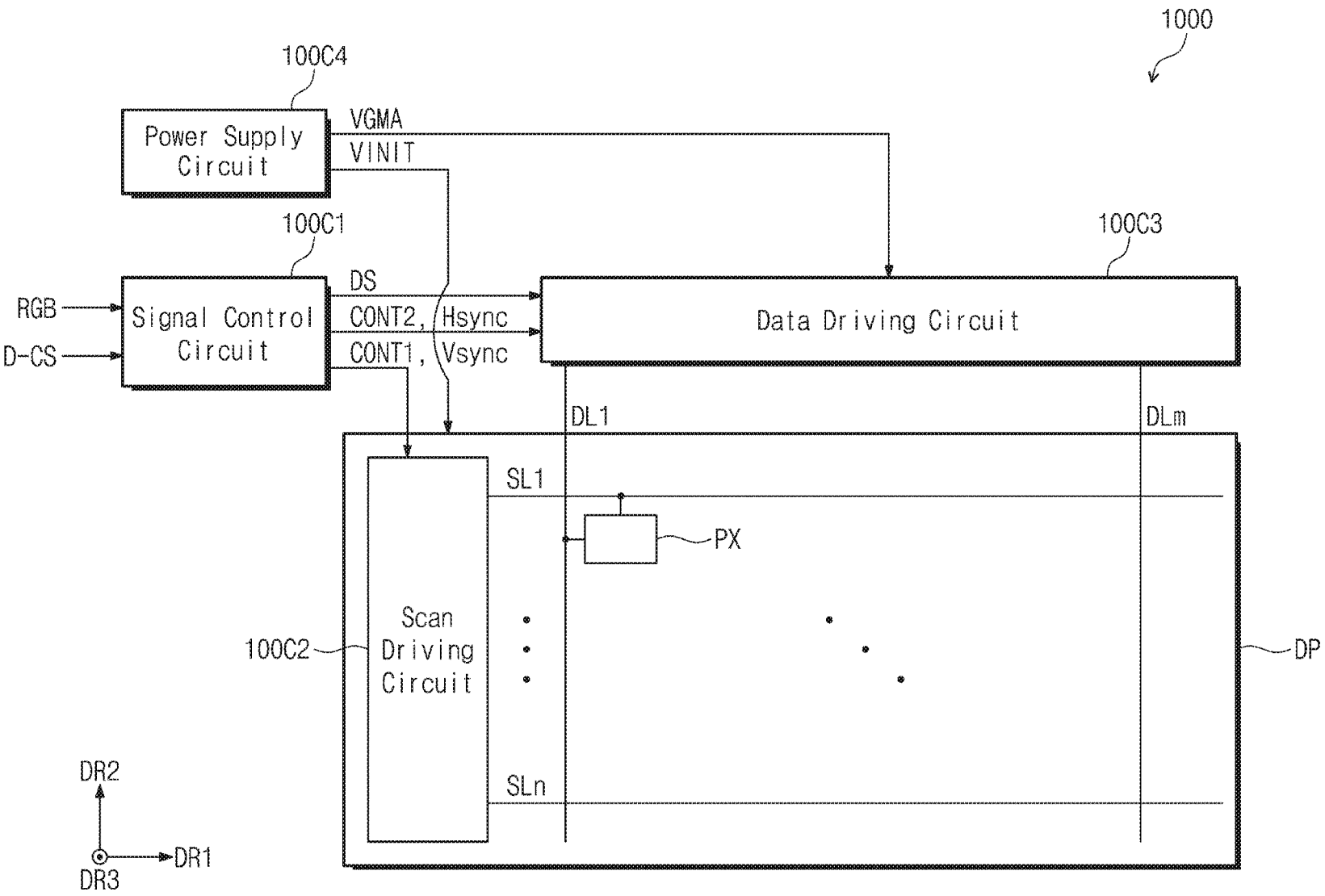
FIG. 2 is a block diagram of the electronic device, according to an embodiment of the present disclosure.

FIG. 2 is a block diagram of the electronic device, according to an embodiment of the present disclosure.

Referring to FIG. 2, the electronic device 1000 may include the display panel DP, a signal control circuit 100C1, a scan driving circuit 100C2, a data driving circuit 100C3, and a power supply circuit 100C4.

The display panel DP may include a plurality of scan lines SL1 to SLn, a plurality of data lines DL1 to DLm, and the plurality of pixels PX. Each of the plurality of pixels PX may be connected with a corresponding data line of the plurality of data lines DL1 to DLm and may be connected with a corresponding scan line of the plurality of scan lines SL1 to SLn. In an embodiment of the present disclosure, the display panel DP may further include light emitting control lines, and the electronic device 1000 may further include a light emitting driving circuit that provides control signals to the light emitting control lines. The configuration of the display panel DP is not particularly limited.

The signal control circuit 100C1 may receive input data RGB and a control signal D-CS from an external control unit. The external control unit may include a graphic processing unit. The control signal D-CS may include various signals. For example, the control signal D-CS may include an input vertical synchronization signal, an input horizontal synchronization signal, a main clock, and a data enable signal.

The signal control circuit 100C1 may generate a first control signal CONT1 and a vertical synchronization signal Vsync based on the control signal D-CS, and may output the first control signal CONT1 and the vertical synchronization signal Vsync to the scan driving circuit 100C2. The vertical synchronization signal Vsync may be included in the first control signal CONT1.

The signal control circuit 100C1 may generate a second control signal CONT2 and a horizontal synchronization signal Hsync, based on the control signal D-CS, and may output the second control signal CONT2 and the horizontal synchronization signal Hsync to the data driving circuit 100C3. The horizontal synchronization signal Hsync may be included in the second control signal CONT2.

The signal control circuit 100C1 may output a data signal DS obtained by processing the input data RGB according to an operating condition of the display panel DP to the data driving circuit 100C3. The first control signal CONT1 and the second control signal CONT2 are signals for controlling the operation of the scan driving circuit 100C2 and the data driving circuit 100C3, and are not particularly limited thereto.

The scan driving circuit 100C2 may drive a plurality of scan lines SL1 to SLn in response to the first control signal CONT1 and the vertical synchronization signal Vsync. In an embodiment, the scan driving circuit 100C2 may be formed in the same process as the circuit layer in the display panel DP, but is not limited thereto. For example, the scan driving circuit 100C2 may be implemented as an integrated circuit (IC), and for electrical connection with the display panel DP, the integrated circuit of the scan driving circuit 100C2 may be directly mounted in a given area of the display panel DP or may be mounted on a separate printed circuit board in a chip on film (COF) manner.

The data driving circuit 100C3 may output gray scale voltages for driving the plurality of data lines DL1 to DLm in response to the second control signal CONT2, the horizontal synchronization signal Hsync, and the data signal DS from the signal control circuit 100C1. The data driving circuit 100C3 may be implemented as an integrated circuit, and for electrical connection with the display panel DP, the integrated circuit of the data driving circuit 100C3 may be directly mounted in a given area of the display panel DP or may be mounted on a separate printed circuit board in the chip on film manner, but the present disclosure is not limited thereto. For example, the data driving circuit 100C3 may be formed in the same process as the circuit layer in the display panel DP.

The power supply circuit 100C4 may trim the voltage based on a control value calculated or generated based on a voltage (i.e., an output voltage) driving the display panel DP. The power supply circuit 100C4 may trim a first voltage VINIT to provide a trimmed first voltage to the display panel DP. The power supply circuit 100C4 may trim a second voltage VGMA and output a trimmed second voltage to the data driving circuit 100C3. The trimming is a calibration method belonging to a post-production process, and is a method of measuring the voltage to determine a deviation of the voltage and correcting the voltage to reach a target performance.

The first voltage VINIT may be referred to as a reference voltage, and the second voltage VGMA may be referred to as a gamma voltage. The power supply circuit 100C4 may be referred to as a power management integrated circuit (PMIC) that generates a reference voltage and a gamma voltage.

The power supply circuit 100C4 may set the first voltage VINIT and the second voltage VGMA to appropriate levels in consideration of conditions such as the size of the display panel DP used in manufacturing the electronic device 1000.

The power supply circuit 100C4 may be implemented as an integrated circuit, and for electrical connection with the display panel DP, the integrated circuit of the power supply circuit 100C4 may be mounted on a separate printed circuit board of the display panel DP in the chip on film manner, or may be directly mounted in a given area, but the present disclosure is not limited thereto. For example, the power supply circuit 100C4 may be formed in the same process as the circuit layer in the display panel DP.

Figure 3:
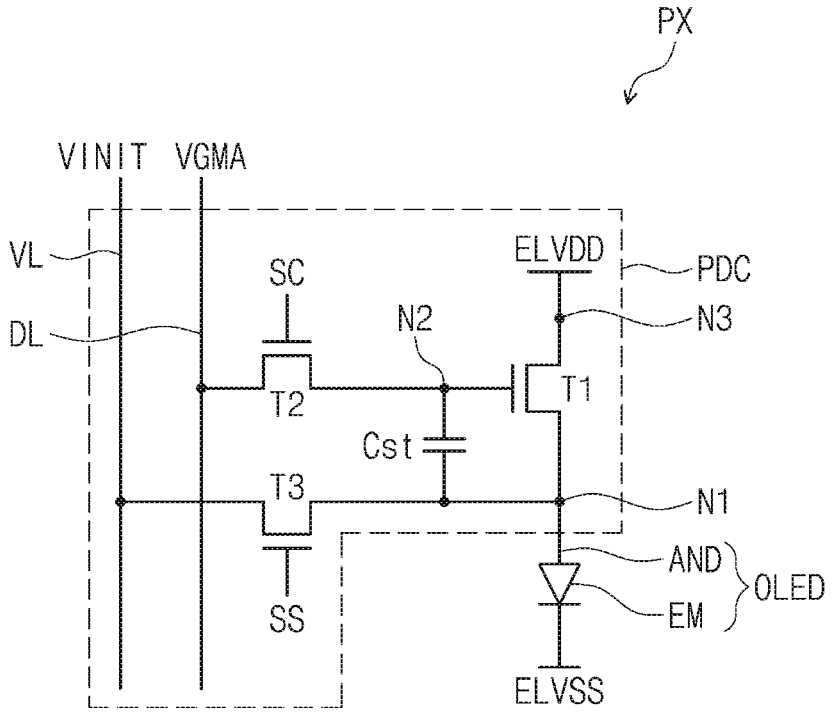
FIG. 3 is an equivalent circuit diagram of a pixel, according to an embodiment of the present disclosure.

FIG. 3 is an equivalent circuit diagram of a pixel, according to an embodiment of the present disclosure. FIG. 3 is an equivalent circuit diagram of one of the plurality of pixels PX of FIG. 2 by way of example.

Referring to FIGS. 2 and 3, the pixel PX may include a pixel driving circuit PDC and a light emitting diode OLED.

The pixel driving circuit PDC according to an embodiment of the present disclosure may include, for example, three transistors and one capacitor. As described above, the pixel PX configured to include three transistors and one capacitor may be referred to as "having a 3T1C structure". However, this is an example and the number of transistors and capacitors of the pixel driving circuit PDC according to an embodiment is not limited thereto.

The pixel driving circuit PDC may include a driving transistor T1, a switching transistor T2, a sensing transistor T3, a capacitor Cst, a data line DL, and a reference voltage line VL.

The light emitting diode OLED may operate in an on state or an off state. The light emitting diode OLED may include a first electrode AND, a light emitting device EM, and a second electrode. The first electrode AND may be referred to as the anode AND. The second electrode may be referred to as a cathode.

The first electrode AND may be electrically connected to a source node or a drain node of the driving transistor T1. A second power source ELVSS may be provided to the second electrode.

The driving transistor T1 may supply a driving current to the light emitting diode OLED to drive the light emitting diode OLED.

The driving transistor T1 may have a first node N1 corresponding to a source node or a drain node, a second node N2 corresponding to a gate node, and a third node N3 corresponding to a drain node or a source node. FIG. 3 illustrates the driving transistor T1 of which the first node N1 is the source node, the second node N2 is the gate node, and the third node N3 is the drain node.

The first node N1 may be electrically connected to the first electrode AND of the light emitting diode OLED. A first power source ELVDD may be provided to the third node N3.

The switching transistor T2 may be a transistor for transferring the second voltage VGMA to the second node N2. The switching transistor T2 may be controlled by a scan signal SC provided to the gate node and may be electrically connected between the second node N2 and the data line DL. For example, the switching transistor T2 may selectively connect the second node N2 and the data line DL with each other.

The capacitor Cst may be electrically connected between the first node N1 and the second node N2 of the driving transistor T1. The capacitor Cst may be referred to as the storage capacitor Cst. The capacitor Cst may serve to maintain a uniform voltage for one frame time.

The sensing transistor T3 may be controlled by a sensing signal SS provided to the gate node, and may be electrically connected between the reference voltage line VL and the first node N1. For example, the sensing transistor T3 may selectively connect the reference voltage line VL and the first node N1 with each other.

The sensing transistor T3 may be turned on to provide the first voltage VINIT supplied through the reference voltage line VL to the first node N1 of the driving transistor T1.

The trimmed second voltage VGMA may be provided to the switching transistor T2. The voltage of the gate node of the driving transistor T1 may be formed based on the second voltage VGMA trimmed by the power supply circuit 100C4.

The trimmed first voltage VINIT may be provided to the sensing transistor T3. The voltage of the source node of the driving transistor T1 may be formed based on the first voltage VINIT trimmed by the power supply circuit 100C4.

The driving current of the light emitting diode OLED may be determined based on a voltage Vgs of the driving transistor T1. The voltage Vgs may be calculated or generated based on the first voltage VINIT and the second voltage VGMA. For example, the voltage Vgs may be calculated or generated based on a value obtained by subtracting the first voltage VINIT from the second voltage VGMA. For example, the voltage Vgs may correspond to a voltage difference between the first voltage VINT and the second voltage VGMA.

Unlike the present disclosure, the first voltage VINIT provided from the power supply circuit 100C4 may have a different value from a target value due to a deviation in the output voltage of a circuit board. In addition, the second voltage VGMA provided from the power supply circuit 100C4 may have a different value from a target value due to a deviation of the output voltage of the circuit board. When the first voltage VINIT has a higher level than the second voltage VGMA, the voltage Vgs may decrease and the driving current of the light emitting diode OLED may decrease. Accordingly, a luminance of the light emitting diode OLED may be reduced. When the second voltage VGMA has a higher level than the first voltage VINIT, the voltage Vgs may increase and the driving current of the light emitting diode OLED may increase. Accordingly, the luminance of the light emitting diode OLED may be increased. That is, a luminance difference may be generated in the electronic device 1000 due to the output voltage deviation. However, according to the present disclosure, the power supply circuit 100C4 may perform a trimming operation on the first voltage VINIT and the second voltage VGMA in consideration of the output voltage deviation. The power supply circuit 100C4 may trim the first voltage VINIT. The power supply circuit 100C4 may trim the second voltage VGMA. The trimmed first voltage VINIT and the trimmed second voltage VGMA may be provided to the pixel PX. Accordingly, it is possible to provide the electronic device 1000 with improved display quality. The trimming operation will be described later.

Figure 4A:
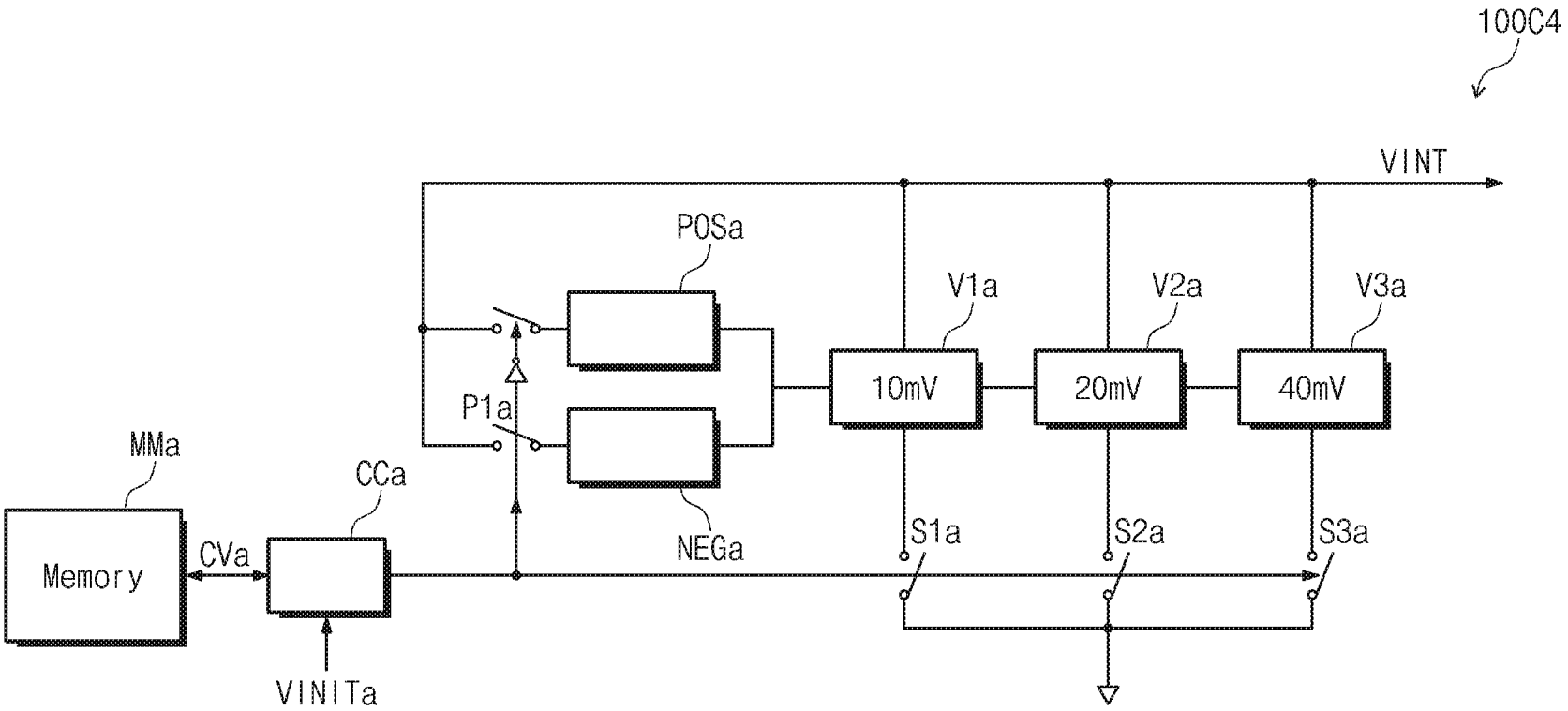
FIG. 4A is a block diagram illustrating a power supply circuit, according to an embodiment of the present disclosure.
Figure 4B:
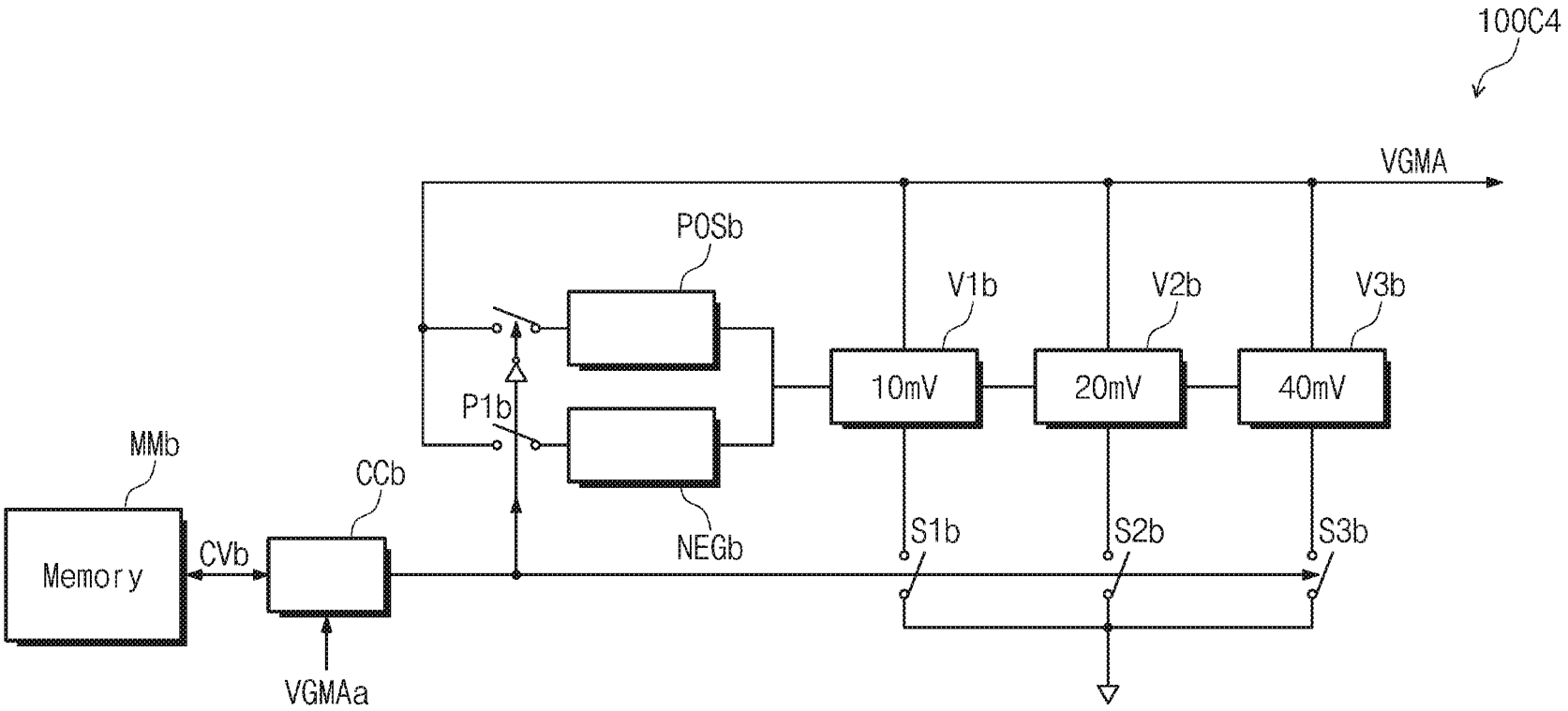
FIG. 4B is a block diagram illustrating a power supply circuit, according to an embodiment of the present disclosure.
Figure 5:
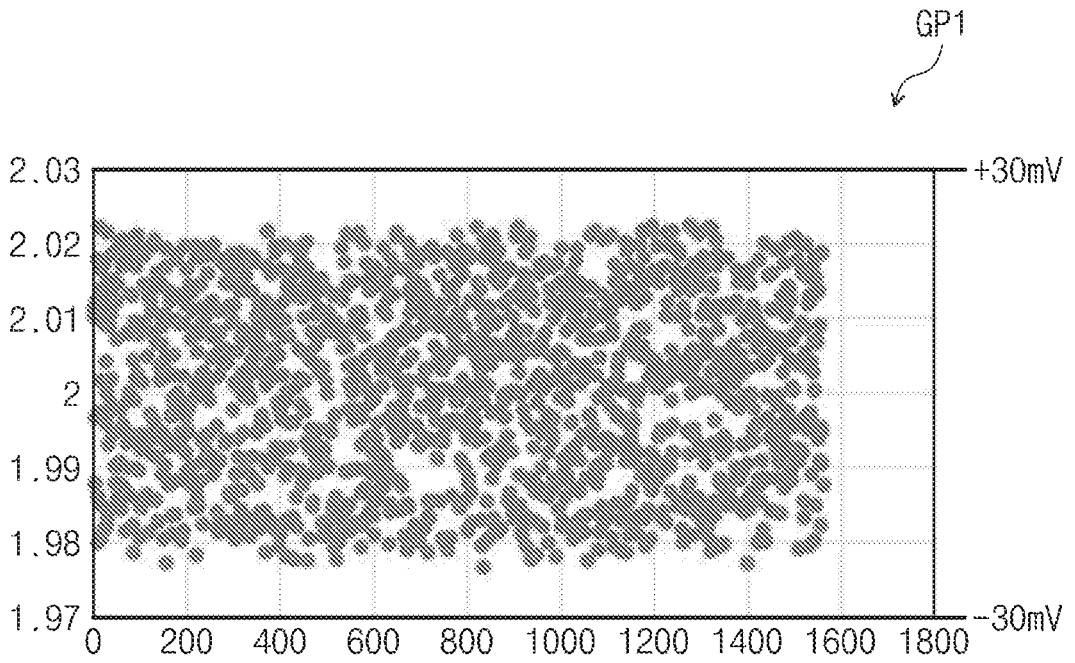
FIG. 5 is a graph illustrating an output voltage scattered around a first voltage, according to an embodiment of the present disclosure.
Figure 6:
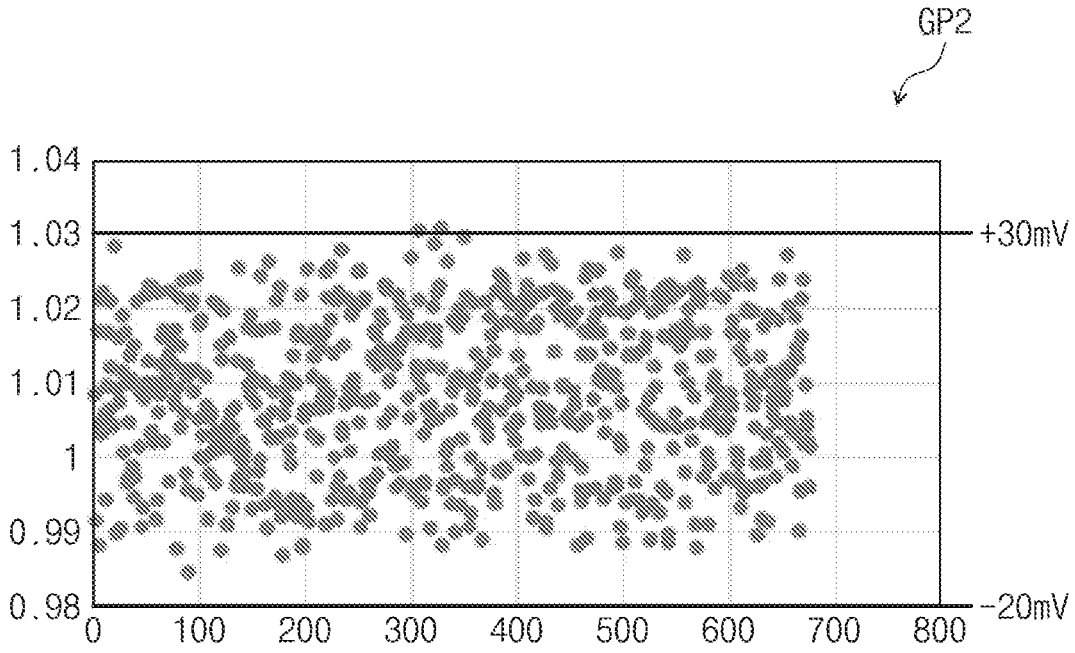
FIG. 6 is a graph illustrating an output voltage scattered around a second voltage, according to an embodiment of the present disclosure.
Figure 7:
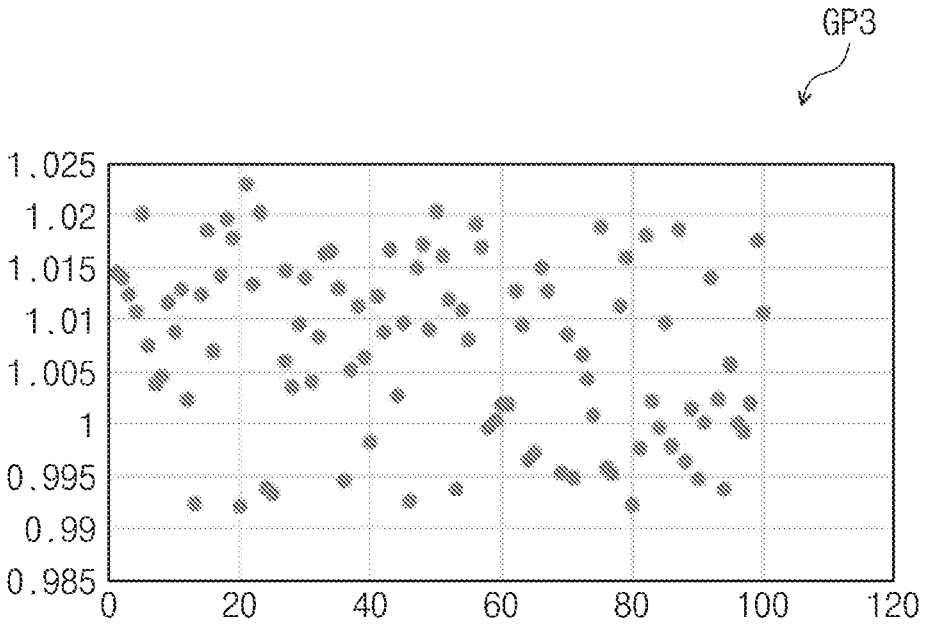
FIG. 7 is a graph illustrating an output voltage scattered around a trimmed second voltage, according to an embodiment of the present disclosure.

FIGS. 4A and 4B are block diagrams illustrating a power supply circuit, according to an embodiment of the present disclosure, FIG. 5 is a graph illustrating an output voltage scattered around a first voltage, according to an embodiment of the present disclosure, FIG. 6 is a graph illustrating an output voltage scattered around a second voltage, according to an embodiment of the present disclosure, and FIG. 7 is a graph illustrating an output voltage scattered around a trimmed second voltage, according to an embodiment of the present disclosure.

Referring to FIGS. 4A to 7, the power supply circuit 100C4 may include controllers CCa and CCb, sign determining units POSa, POSb, NEGa, and NEGb (i.e., sign determining circuits), and a plurality of voltage controllers V1*a*, V1*b*, V2*a*, V2*b*, V3*a*, and V3*b* (i.e., a plurality of voltage generators), and a memory MM. For example, each voltage controller of the plurality of voltage controllers V1*a*, V1*b*, V2*a*, V2*b*, V3*a*, and V3*b* may output a corresponding voltage.

The controller CCa may receive a first voltage VINITa. The controller CCa may generate a control value CVa calculated or generated based on the first voltage VINITa driving the display panel DP (refer to FIG. 2). For example, the first voltage VINTa may be an output voltage of the power supply circuit 100C4 to be supplied to the display panel DP, and depending on a difference between the first voltage VINTa and a target voltage, the power supply circuit 100C4 may trim the first voltage VINTa to generate a trimmed first voltage VINT. The control value CVa may control a sign and a trimming voltage. The sign may refer to a sign of a voltage set by the control value CVa to trim the first voltage VINITa. The trimming voltage may refer to a level of a voltage set by the control value CVa to trim the first voltage VINITa.

The controller CCb may receive a second voltage VGMAa. The controller CCb may generate a control value CVb calculated or generated based on the second voltage VGMAa driving the display panel DP (refer to FIG. 2). For example, the second voltage VGMAa may be an output voltage of the power supply circuit 100C4 to be supplied to the display panel DP, and depending on a difference between the second voltage VGMAa and a target voltage, the power supply circuit 100C4 may trim the second voltage VGMAa to generate a trimmed second voltage VGMA. The control value CVb may control a sign and a trimming voltage. The sign may refer to a sign of a voltage set by the control value CVb to trim the second voltage VGMAa. The trimming voltage may refer to a level of a voltage set by the control value CVb to trim the second voltage VGMAa.

The sign determining units POSa and NEGa may determine (or may set) the sign based on the first voltage VINITa. The sign determining units POSa and NEGa may include the first sign determining unit POSa and the second sign determining unit NEGa. For example, when 0 is included in array of the control value CVa, the first sign determining unit POSa may be selected, and when 1 is included, the second sign determining unit NEGa may be selected.

The first sign determining unit POSa may set a sign of the trimming voltage as a first sign. The first sign may be a positive sign.

The second sign determining unit NEGa may set a sign of the trimming voltage as a second sign. The second sign may be different from the first sign. The second sign may be a negative sign.

The sign determining units POSb and NEGb may determine a sign based on the second voltage VGMAa. The sign determining units POSb and NEGb may include the first sign determining unit POSb and the second sign determining unit NEGb.

The first sign determining unit POSb may set a sign of the trimming voltage as the first sign. The first sign may be a positive sign.

The second sign determining unit NEGb may set a sign of the trimming voltage as the second sign.

The plurality of voltage controllers V1*a*, V2*a*, and V3*a* may output the trimming voltage based on the first voltage VINITa.

The plurality of voltage controllers V1*b*, V2*b*, and V3*b* may output the trimming voltage based on the second voltage VGMAa.

The plurality of voltage controllers V1*a*, V1*b*, V2*a*, V2*b*, V3*a*, and V3*b* may include the first voltage controllers V1*a* and V1*b*, the second voltage controllers V2*a* and V2*b*, and the third voltage controllers V3*a* and V3*b*.

The first voltage controllers V1*a* and V1*b* may output a first trimming voltage. For example, the first trimming voltage may be 10 mV (millivolt).

The second voltage controllers V2*a* and V2*b* may output a second trimming voltage. For example, the second trimming voltage may be 20 mV.

The third voltage controllers V3*a* and V3*b* may output a third trimming voltage. For example, the third trimming voltage may be 40 mV.

The controller CCa may calculate or generate the trimming voltage by combining at least one of the first voltage controller V1*a*, the second voltage controller V2*a*, and the third voltage controller V3*a* based on the control value CVa. The trimming voltage may be calculated or generated to have a value selected from a range of from 10 mV to 70 mV in units of 10 mV For example, the controller CCa may apply a trimming of 10 mV using the first voltage controller V1*a*. The controller CCa may apply a trimming of 70 mV using the first voltage controller V1*a*, the second voltage controller V2*a*, and the third voltage controller V3*a*. In an embodiment, the controller CCa, in response to the first control value CVa, may cause the first to third voltage controllers V1*a* to V3*a* to selectively supply at least one of the first to third trimming voltages to generate a trimmed first voltage VINT.

The controller CCb may calculate or generate the trimming voltage by combining at least one of the first voltage controller V1*b*, the second voltage controller V2*b*, and the third voltage controller V3*b* based on the control value CVb. The trimming voltage may be calculated or generated to have a value selected in a range of from 10 mV to 70 mV in units of 10 mV. In an embodiment, the controller CCb, in response to the second control value CVb, may cause the first to third voltage controllers V1*b* to V3*b* to selectively supply at least one of the first to third trimming voltages to generate a trimmed second voltage VGMA.

A memory MMa may store the control value CVa calculated or generated based on the first voltage VINITa. The memory MMa may store the control value CVa in the form of a lookup table.

A memory MMb may store the control value CVb calculated or generated based on the second voltage VGMAa. The memory MMb may store the control value CVb in the form of a lookup table.

In the process of testing the electronic device 1000, the power supply circuit 100C4 may calculate or generate the control values CVa and CVb. The power supply circuit 100C4 may calculate a voltage required for trimming by comparing a measured voltage measured during the test with a target voltage to be actually applied, and may generates a control value CVa and CVb in the form of an array to control the voltage.

A first graph GP1 (refer to FIG. 5) is a graph illustrating the measurement of the output voltage scattered around the untrimmed first voltages VINITa. A horizontal axis of the first graph GP1 may indicate the number or sample number of a plurality of measured samples. A vertical axis of the first graph GP1 may indicate an output voltage of each of the samples. The unit of the output voltage may be volts V. The first voltage VINITa provided to the display panel DP may be provided as a specified first target value. For example, the first target value may be provided as 2V (Volt). The first voltage VINITa may be measured as an output voltage scattering in a range of 60 mV.

The power supply circuit 100C4 may calculate the control value CVa for trimming the first voltage VINITa based on the measured output voltage scattered in the first graph GP1. When the first voltage VINITa deviates from the first target value, the power supply circuit 100C4 may trim the first voltage VINITa to calculate a trimmed first voltage VINIT. The sign determining units POSa and NEGa and the plurality of voltage controllers V1*a*, V2*a*, and V3*a* may trim the first voltage VINITa to be close to the first target value. In this case, a turn-on-off condition of each of the sign determining units POSa and NEGa and the plurality of voltage controllers V1*a*, V2*a*, and V3*a* may be stored in the memory MMa as the control value CVa. The memory MMa may provide the control value CVa to the controller CCa when the display panel DP is driven. The control value CVa may control each of the sign determining units POSa and NEGa and the plurality of voltage controllers V1*a*, V2*a*, and V3*a*.

Referring to a fourth graph GP4 (refer to FIG. 9), the first voltage VINIT provided to the display panel DP may be a voltage trimmed to be close to the first target value. Referring to the fourth graph GP4 (refer to FIG. 9), the trimmed first voltage VINIT may be measured as an output voltage scattered within a range of 40 mV or less. That is, the trimmed first voltage VINIT having an improved output voltage scattering may be provided to the display panel DP.

According to the present disclosure, the power supply circuit 100C4 may calculate the control value CVa for trimming the output voltage based on the output voltage scattered around the first voltage VINITa measured in the process of testing the electronic device 1000. The power supply circuit 100C4 may respectively control the sign determining units POSa and NEGa and the plurality of voltage controllers V1*a*, V2*a*, and V3*a*, based on the control value CVa when the display panel DP is driven. That is, the electronic device 1000 may trim the output voltage scattered around the first voltage VINITa that may be generated by the power supply circuit 100C4 based on the first target value to obtain the trimmed first voltage VINIT. That is, the power supply circuit 100C4 may improve the output voltage scattering. Accordingly, it is possible to provide the electronic device 1000 with improved display quality.

A second graph GP2 (refer to FIG. 6) is a graph illustrating the measurement of the output voltage scattered around the untrimmed second voltages VGMAa. A horizontal axis of the second graph GP2 may indicate the number or sample number of a plurality of measured samples. A vertical axis of the second graph GP2 may indicate an output voltage of each of the samples. The unit of the output voltage may be volts V. The second voltage VGMAa provided to the display panel DP may be provided as a specified second target value. For example, the second target value may be provided as 1V (1 Volt). The second voltage VGMAa may be measured as an output voltage scattering in a range of 50 mV.

The power supply circuit 100C4 may calculate the control value CVb for trimming the second voltage VGMAa based on the measured output voltage scattered as shown in the second graph GP2.

When the second voltage VGMAa deviates from the second target value, the power supply circuit 100C4 may trim the second voltage VGMAa to calculate the trimmed second voltage VGMA. The sign determining units POSb and NEGb and the plurality of voltage controllers V1*b*, V2*b*, and V3*b* may trim the second voltage VGMAa to be close to the second target value. In this case, a turn-on-off condition of each of the sign determining units POSb and NEGb and the plurality of voltage controllers V1*b*, V2*b*, and V3*b* may be stored in the memory MMb as the control value CVb. The memory MMb may provide the control value CVb to the controller CCb when the display panel DP is driven. The control value CVb may control each of the sign determining units POSb and NEGb and the plurality of voltage controllers V1*b*, V2*b*, and V3*b*.

A third graph GP3 (refer to FIG. 7) illustrates a measurement of the output voltage scattered around the second voltages VGMA trimmed by the power supply circuit 100C4, according to an embodiment of the present disclosure. A horizontal axis of the third graph GP3 may indicate the number or sample number of a plurality of measured samples. A vertical axis of the third graph GP3 may indicate an output voltage of each of the samples. The unit of the output voltage may be volts. The second voltage VGMA provided to the display panel DP may be a voltage trimmed to be close to the second target value. Referring to the third graph GP3, the trimmed second voltage VGMA may be measured with an output voltage scattered within a range of 35 mV or less. That is, the trimmed second voltage VGMA having an improved output voltage scattering may be provided to the display panel DP.

According to the present disclosure, the power supply circuit 100C4 may calculate the control value CVb for trimming the output voltage based on the output voltage scattered around the second voltage VGMAa measured in the process of testing the electronic device 1000. For example, in the process of testing, a voltage difference between a target voltage and its measured voltage such as VINTa and VGMAa is measured as a trim voltage, and various switching signals P1*a* and S1*a* to S3*a* or P1*b* and S1*b* to S3*b* are set to control the POSa and V1*a* to V3*a* or POSb and V1*b* to V3*b* to generate the trim voltage. The power supply circuit 100C4 may respectively control the sign determining units POSb and NEGb and the plurality of voltage controllers V1*b*, V2*b*, and V3*b*, based on the control value CVb when the display panel DP is driven. That is, the electronic device 1000 may trim the output voltage scattered around the second voltage VGMAa that may be generated by the power supply circuit 100C4 based on the second target value to obtain the trimmed second voltage VGMA. That is, the power supply circuit 100C4 may improve the stability of the output voltage. Accordingly, it is possible to provide the electronic device 1000 with improved display quality.

TABLE 1

| P1a, P1b | S3a, S3b | S2a, S2b | Sla, S1b | TrimVoltage |
|---|---|---|---|---|
| 0 | 0 | 0 | 0 | 0 mV |
| 0 | 0 | 0 | 1 | +10 mV |

TABLE 1-continued

| P1a, P1b | S3a, S3b | S2a, S2b | S1a, S1b | TrimVoltage |
|---|---|---|---|---|
| 0 | 0 | 1 | 0 | +20 mV |
| 0 | 0 | 1 | 1 | +30 mV |
| 0 | 1 | 0 | 0 | +40 mV |
| 0 | 1 | 0 | 1 | +50 mV |
| 0 | 1 | 1 | 0 | +60 mV |
| 0 | 1 | 1 | 1 | +70 mV |
| 1 | 0 | 0 | 0 | 0 mV |
| 1 | 0 | 0 | 1 | −10 mV |
| 1 | 0 | 1 | 0 | −20 mV |
| 1 | 0 | 1 | 1 | −30 mV |
| 1 | 1 | 0 | 0 | −40 mV |
| 1 | 1 | 0 | 1 | −50 mV |
| 1 | 1 | 1 | 0 | −60 mV |
| 1 | 1 | 1 | 1 | −70 mV |

Table 1 illustrates the turn-on-off condition of each of the sign determining units POSa, POSb, NEGa, and NEGb and the plurality of voltage controllers V1*a*, V1*b*, V2*a*, V2*b*, V3*a*, and V3*b* with respect to the control value CV. The controller CC may turn on one of the first sign determining units POSa and POSb and the second sign determining units NEGa and NEGb based on the control value CV.

Referring to Table 1, when a value of '0' is provided to first switches P1*a* and P1*b*, the first sign determining units POSa and POSb may be connected. When a value of '1' is provided to the first switches P1*a* and P1*b*, the second sign determining units NEGa and NEGb may be connected.

The controllers CCa and CCb may calculate the trimming voltage by combining at least one of the first voltage controllers V1*a* and V1*b*, the second voltage controllers V2*a* and V2*b*, and the third voltage controllers V3*a* and V3*b*, based on the control value CV. The trimming voltage may be calculated from 10 mV to 70 mV in units of 10 mV.

When a value of '1' is provided to the second switches S1*a* and S1*b*, the first voltage controllers V1*a* and V1*b* may be connected to an output node of the power supply circuit 100C4.

When a value of '1' is provided to the third switches S2*a* and S2*b*, the second voltage controllers V2*a* and V2*b* may be connected to the output node of the power supply circuit 100C4.

When a value of '1' is provided to the fourth switches S3*a* and S3*b*, the third voltage controllers V3*a* and V3*b* may be connected to the output node of the power supply circuit 100C4.

For example, when trimming of the measured first voltage VINITa or the second voltage VGMAa by about +30 mV from the target value is required, the controllers CCa and CCb may calculate the control values CVa and CVb of "0011". The control values CVa and CVb may be stored in the memory MM. Thereafter, when the display panel DP is operated, the power supply circuit 100C4 may calculate or generate the trimmed first voltage VINIT or the trimmed second voltage VGMA based on the control values CVa and CVb. The trimmed first voltage VINIT or the trimmed second voltage VGMA may be provided to each of the plurality of pixels PX (refer to FIG. 3). Accordingly, it is possible to provide the electronic device 1000 with improved display quality.

In addition, for example, when trimming of the measured first voltage VINITa or the second voltage VGMAa by about −40 mV from the target value is required, the controllers CCa and CCb may calculate the control values CVa and CVb of "1100". The control values CVa and CVb may be stored in the memory MM. Thereafter, when the display panel DP is operated, the power supply circuit 100C4 may calculate the trimmed first voltage VINIT or the trimmed second voltage VGMA based on the control values CVa and CVb. The trimmed first voltage VINIT or the trimmed second voltage VGMA may be provided to each of the plurality of pixels PX (refer to FIG. 3). Accordingly, it is possible to provide the electronic device 1000 with improved display quality.

Figure 8A:
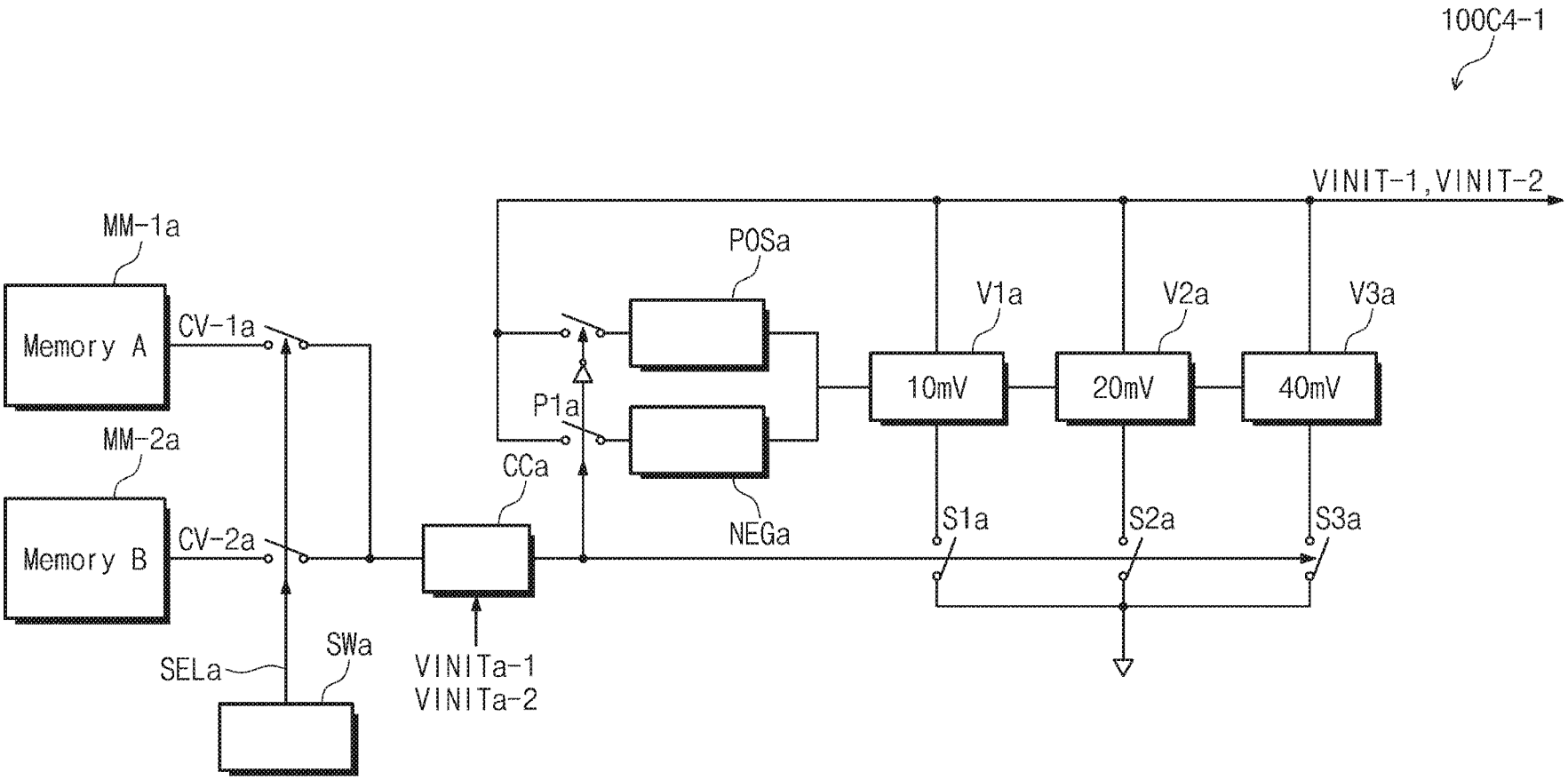
FIG. 8A is a block diagram illustrating a power supply circuit, according to an embodiment of the present disclosure.
Figure 8B:
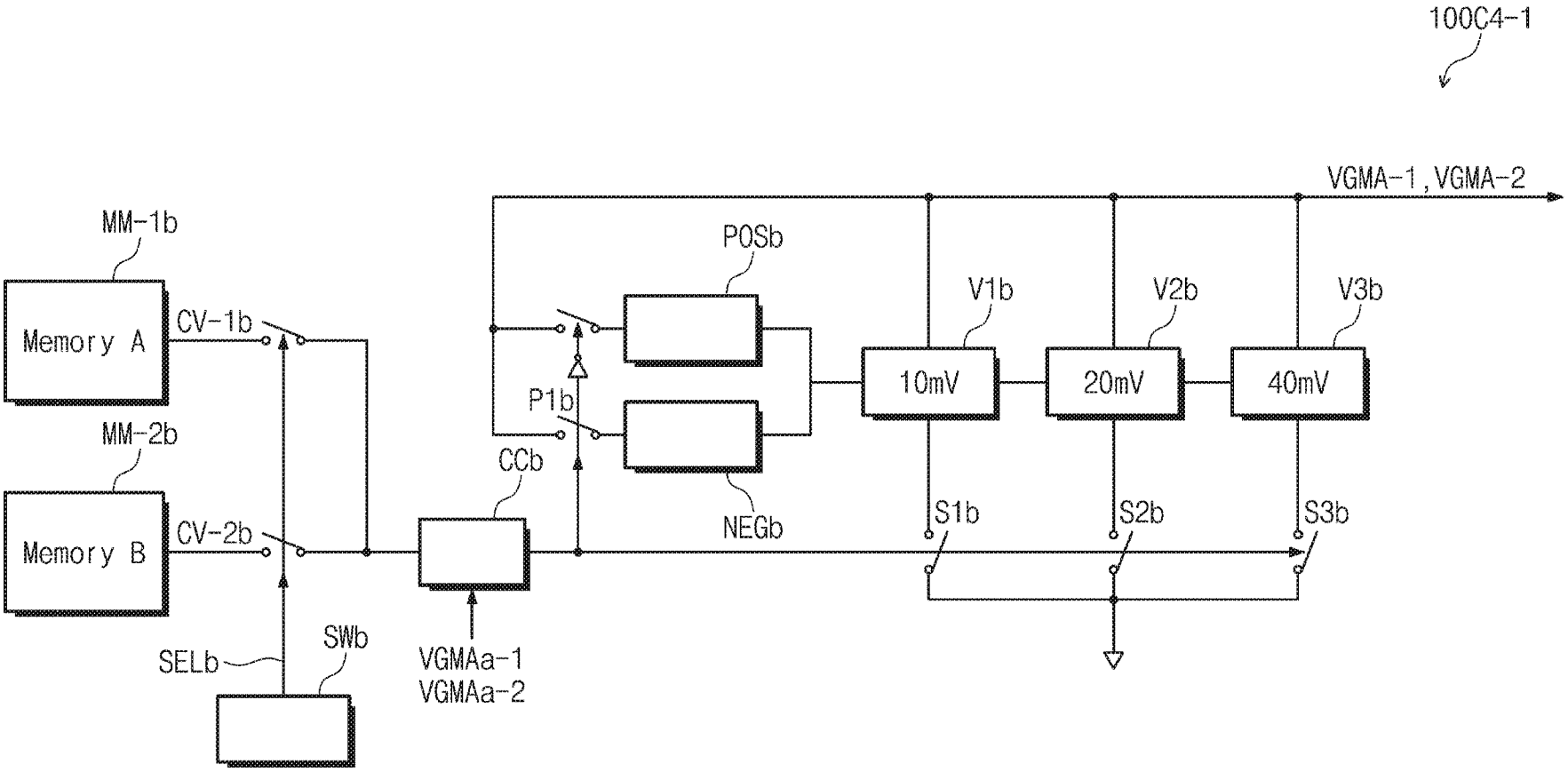
FIG. 8B is a block diagram illustrating a power supply circuit, according to an embodiment of the present disclosure.
Figure 9:
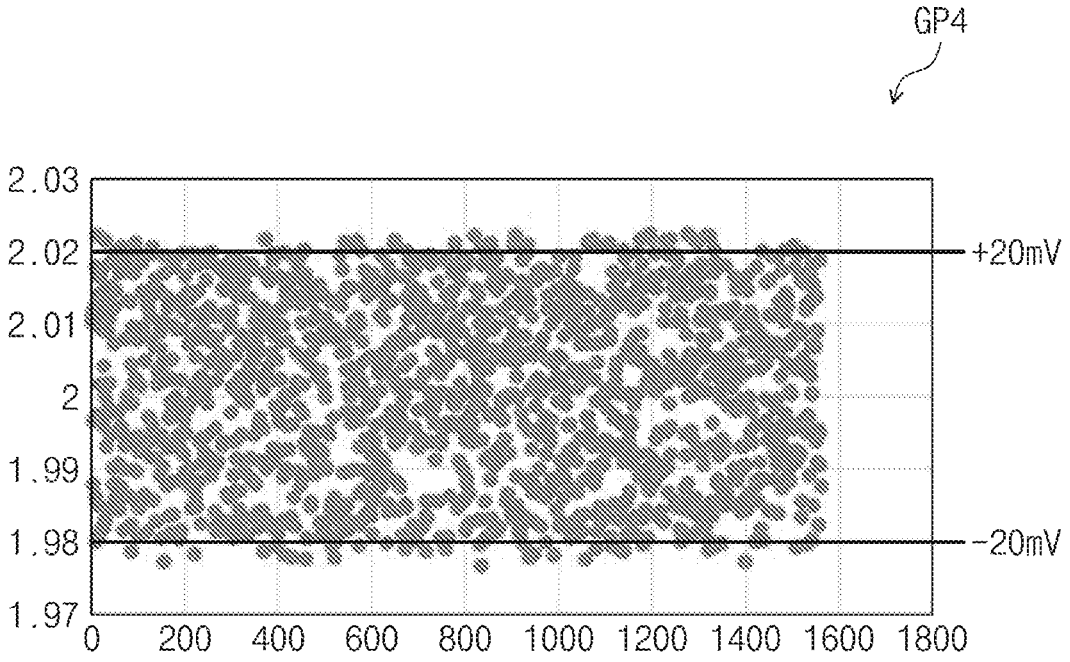
FIG. 9 is a graph illustrating an output voltage scattered around a first voltage, according to an embodiment of the present disclosure.
Figure 10:
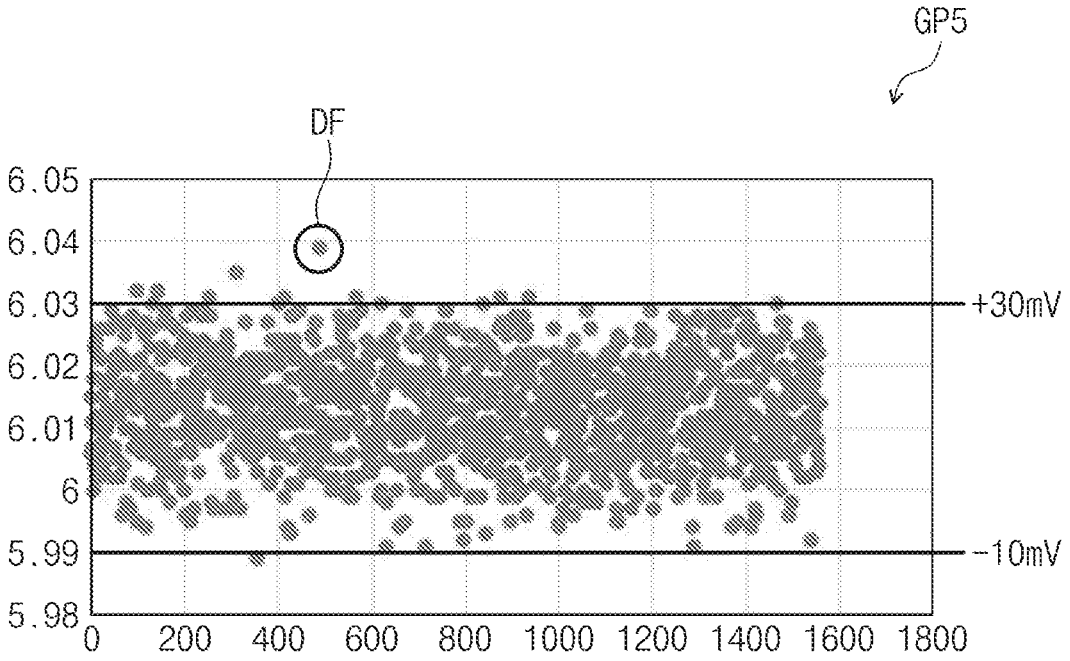
FIG. 10 is a graph illustrating an output voltage scattered around a first voltage, according to an embodiment of the present disclosure.

FIGS. 8A and 8B are a block diagrams illustrating a power supply circuit, according to an embodiment of the present disclosure, FIG. 9 is a graph illustrating an output voltage scattered around a first voltage, according to an embodiment of the present disclosure, and FIG. 10 is a graph illustrating an output voltage scattered around a first voltage, according to an embodiment of the present disclosure. In the description of FIGS. 8A and 8B, the same reference numerals are used for the components described with reference to FIGS. 4A and 4B, and additional description thereof will be omitted to avoid redundancy.

Referring to FIGS. 2 and 8A to 10, a power supply circuit 100C4-1 may include the controllers CCa and CCb, the sign determining units POSa, POSb, NEGa, and NEGb, and the plurality of voltage controllers V1*a*, V1*b*, V2*a*, V2*b*, V3*a*, and V3*b*, a plurality of memories MM-1*a*, MM-2*a*, MM-1*b*, and MM-2*b*, and switching units SWa and SWb (i.e., switching circuits).

The plurality of memories MM-1*a*, MM-2*a*, MM-1*b*, and MM-2*b* may include the first memories MM-1*a* and MM-1*b* and the second memories MM-2*a* and MM-2*b*.

The switching unit SWa may select one of the plurality of memories MM-1*a* and MM-2*a* depending on the type of the display panel DP through a selection signal SELa. The switching unit SWa may provide corresponding control value (CV-1*a* or CV-2*a*) among the plurality of control values CV-1*a* and CV-2*a* to the controller CCa. For example, the switching unit SWa may select the first memory MM-1*a* when the display panel DP is applied to a television, and the switching unit SWa may select the second memory MM-2*a* when the display panel DP is applied to a monitor.

The reference voltage may have a first voltage VINITa-1 when the display panel DP is of a first type, and the reference voltage may have a third voltage VINITa-2 having a different level from the first voltage VINITa-1 when the display panel DP is of a second type different from the first type. For example, the first voltage VINITa-1 may be 2V, and the third voltage VINITa-2 may be 6V.

The switching unit SWb may select one of the plurality of memories MM-1*b* and MM-2*b* depending on the type of the display panel DP through a selection signal SELb. The switching unit SWb may provide a corresponding control value (CV-1*b* or CV-2*b*) among the plurality of control values CV-1*b* and CV-2*b* to the controller CCb. For example, the switching unit SWb may select the first memory MM-1*b* when the display panel DP is applied to a television, and the switching unit SWb may select the second memory MM-2*b* when the display panel DP is applied to a monitor.

The gamma voltage may have a second voltage VGMAa-1 when the display panel DP is of the first type, and the gamma voltage may have a fourth voltage VGMAa-2 having a different level from the second voltage VGMAa-1 when the display panel DP is of the second type.

The power supply circuit 100C4-1 may provide a trimmed first voltage VINIT-1 to the display panel DP when the first memory MM-1*a* is selected.

The power supply circuit 100C4-1 may provide a trimmed second voltage VGMA-1 to the data driving circuit 100C3 when the first memory MM-1*b* is selected.

The power supply circuit 100C4-1 may provide a trimmed third voltage VINIT-2 to the display panel DP when the second memory MM-2*a* is selected.

The power supply circuit 100C4-1 may provide a trimmed fourth voltage VGMA-2 to the data driving circuit 100C3 when the second memory MM-2*b* is selected.

For example, although features driven by two memories are illustrated in FIGS. 8A and 8B, the configuration of the power supply circuit 100C4-1 according to an embodiment of the present disclosure is not limited thereto. For example, the power supply circuit 100C4-1 may further include a plurality of memories, the switching units SWa and SWb may select one of the plurality of memories, and the power supply circuit 100C4-1 may be controlled by a plurality of control values CV-1*a*, CV-1*b*, CV-2*a*, and CV-2*b* respectively corresponding to the plurality of memories.

In the process of testing the electronic device 1000, the power supply circuit 100C4 may calculate the plurality of control values CV-1*a*, CV-1*b*, CV-2*a*, and CV-2*b*.

The fourth graph GP4 (refer to FIG. 9) is a graph illustrating the measurement of the output voltage scattered around the trimmed first voltages VINIT-1. The horizontal axis of the fourth graph GP4 may indicate the number or sample number of a plurality of measured samples. The vertical axis of the fourth graph GP4 may indicate an output voltage of each of the samples. The unit of the output voltage may be volts V. The first voltage VINIT-1 provided to the display panel DP may be provided as a specified first target value. For example, the first target value may be provided as 2V (2 Volts). The first voltage VINIT-1 may be trimmed by the power supply circuit 100C4-1 and may be provided as an output voltage scattering in a range of 40 mV. For example, when the type of the display panel DP is applied to a television, the trimmed first voltage VINIT-1 may be output based on the first voltage VINITa-1.

A fifth graph GP5 (refer to FIG. 10) is a graph illustrating the measurement of the output voltage scattered around the third voltages VINIT-2 in a state in which trimming is applied to the first voltage VINIT-1. A horizontal axis of the fifth graph GP5 may indicate the number or sample number of a plurality of measured samples. A vertical axis of the fifth graph GP5 may indicate an output voltage of each of the samples. The unit of the output voltage may be volts V. The third voltage VINIT-2 provided to the display panel DP may be provided as a specified third target value different from the first target value. For example, the third target value may be provided as 6V (6 Volts). For example, when the type of the display panel DP is a monitor, the third voltage VINIT-2 may be output.

In the process of testing the electronic device 1000, the power supply circuit 100C4 may calculate the control values CV-1*a*, CV-1*b*, CV-2*a*, and CV-2*b* for trimming the output voltage based on the output voltage scattered around each of the first to fourth voltages VINITa-1, VGMAa-1, VINITa-2, and VGMAa-2. The first control value CV-1*a* may be stored in the first memory MM-1*a*, and the second control value CV-2*a* may be stored in the second memory MM-2*a*. The first control value CV-1*b* may be stored in the first memory MM-1*b*, and the second control value CV-2*b* may be stored in the second memory MM-2*b*. When the display panel DP is driven, the switching unit SWa may allow the first memory MM-1*a* in which the first control value CV-1*a* is stored or the second memory MM-2*a* in which the second control value CV-2*a* is stored to be connected to the controller CCa depending on the type of the display panel DP through the selection signal SELa. When the display panel DP is driven, the switching unit SWb may allow the first memory MM-1*b* in which the first control value CV-1*b* is stored or the second memory MM-2*b* in which the second control value CV-2*b* is stored to be connected to the controller CCb depending on the type of the display panel DP through the selection signal SELb.

Unlike the present disclosure, when the third voltage VINIT-2 is calculated with trimming applied to the first voltage VINIT-1, an output voltage scattered within a range of more than 40 mV may occur, resulting in a defect DF. However, according to the present disclosure, the controller CCa may calculate the first control value CV-1*a* or the second control value CV-2*a* depending on the type of the display panel DP. The first control value CV-1*a* or the second control value CV-2*a* may control the sign determining units POSa and NEGa and each of the plurality of voltage controllers V1*a*, V2*a*, and V3*a*. The controllers CCa and CCb may provide the trimmed first to fourth voltages VINIT-1, VGMA-1, VINIT-2, and VGMA-2. That is, it is possible to prevent the defect DF from occurring by appropriately controlling the trimming according to the type of the display panel DP. The power supply circuit 100C4-1 may improve the output voltage scattering. Accordingly, it is possible to provide the electronic device 1000 with improved display quality.

In addition, according to the present disclosure, the same power supply circuit 100C4-1 may be mounted on each of a plurality of different electronic devices 1000 regardless of the type of the display panel DP. Although the power supply circuit 100C4-1 is mounted on a different display panel DP, the power circuit 100C4-1 may perform appropriate trimming control according to the type of the display panel DP, by using the switching units SWa and SWb, and the plurality of memories MM-1*a*, MM-2*a*, MM-1*b*, and MM-2*b*. That is, the manufacturing process of the electronic device 1000 may be simplified and the process yield may be improved. Accordingly, it is possible to provide the electronic device 1000 with improved reliability.

According an embodiment of the present disclosure, the power supply circuit may calculate or generate a control value for trimming the output voltage based on the output voltage scattered around each of the first and second voltages measured during testing of the electronic device. The power supply circuit may control each of the sign determining unit and the plurality of voltage controllers based on the control value stored in the memory when the display panel is driven. That is, the electronic device may trim the output voltage scattered around the first voltage and the second voltage that may be generated by the power supply circuit. That is, the power supply circuit may improve the stability of the output voltage. Accordingly, it is possible to provide an electronic device with improved display quality.

Although an embodiment of the present disclosure has been described for illustrative purposes, those skilled in the art will appreciate that various modifications, and substitutions are possible, without departing from the scope and spirit of the disclosure as disclosed in the accompanying claims. In addition, the embodiments disclosed in the present disclosure are not intended to limit the technical spirit of the present disclosure, and all technical ideas within the scope of the following claims and their equivalents should be construed as being included in the scope of the present disclosure.

What is claimed is:

1. An electronic device comprising:

a display panel including a plurality of scan lines, a plurality of data lines, and a plurality of pixels, and configured to display an image;

a data driving circuit connected to the plurality of data lines;

a scan driving circuit connected to the plurality of scan lines;

a signal control circuit configured to receive input data and to control the display panel, the data driving circuit, and the scan driving circuit; and a power supply circuit configured to:

generate a first output voltage or a second output voltage to drive the display panel;

generate a first control value based on the first output voltage or the second output voltage; and trim the first output voltage or the second output voltage based on the first control value to generate a trimmed first output voltage or a trimmed second output voltage, the second output voltage having a different level from the first output voltage, wherein the power supply circuit includes:

a controller configured to generate the first control value based on the first output voltage or the second output voltage;

a sign determining circuit configured to determine a sign of the first control value based on the first output voltage or the second output voltage;

a plurality of voltage generators configured to supply a trimming voltage of the first control value based on the first output voltage or the second output voltage to generate the trimmed first output voltage or the trimmed second output voltage; and a first memory configured to store the first control value, and wherein the first control value includes a value for controlling the sign determining circuit and a corresponding value for each of the plurality of voltage generators.

2. The electronic device of claim 1, wherein the trimming voltage includes a first trimming voltage, a second trimming voltage, and a third trimming voltage, and wherein the plurality of voltage generators include:

a first voltage generator configured to generate the first trimming voltage;

a second voltage generator configured to generate the second trimming voltage; and a third voltage generator configured to generate the third trimming voltage.

3. The electronic device of claim 2, wherein the first trimming voltage is 10 mV (millivolt), the second trimming voltage is 20 mV, and the third trimming voltage is 40 mV.

4. The electronic device of claim 2, wherein the controller is configured to cause the power supply circuit to selectively supply at least one of the first trimming voltage of the first voltage generator, the second trimming voltage of the second voltage generator, and the third trimming voltage of the third voltage generator to generate the trimmed first output voltage or the trimmed second output voltage.

5. The electronic device of claim 1, wherein the sign determining circuit includes:

a first sign determiner circuit configured to set a sign of the trimming voltage to a first sign; and a second sign determiner circuit configured to set a sign of the trimming voltage to a second sign different from the first sign.

6. The electronic device of claim 1, wherein the first control value includes values to determine whether the sign determining circuit and each of the plurality of voltage generators are turned on.

7. The electronic device of claim 1, wherein the first memory is configured to provide the first control value to the controller when the display panel is driven.

8. The electronic device of claim 1, wherein the first memory stores the first control value in a form of a lookup table.

9. The electronic device of claim 1, wherein the power supply circuit provides the trimmed first output voltage to the display panel and the trimmed second output voltage to the data driving circuit.

10. The electronic device of claim 1, wherein the power supply circuit further includes:

a second memory configured to store a second control value generated based on a third output voltage and a fourth output voltage having a different level from the third output voltage; and a switching circuit configured to select one of the first memory and the second memory to provide one of the first control value and the second control value to the controller.

11. The electronic device of claim 10, wherein the switching circuit selects one of the first memory and the second memory depending on a type of the display panel.

12. The electronic device of claim 10, wherein the first output voltage has a different level than the third output voltage.

13. The electronic device of claim 10, wherein the power supply circuit provides:

when the first memory is selected, the trimmed first output voltage is provided to the display panel and the trimmed second output voltage is provided to the data driving circuit, and when the second memory is selected, a trimmed third output voltage is provided to the display panel and a trimmed fourth output voltage is provided to the data driving circuit.

14. The electronic device of claim 1, wherein each of the plurality of pixels includes:

a pixel driving circuit including a plurality of transistors and at least one capacitor; and a light emitting diode electrically connected to the pixel driving circuit.

15. The electronic device of claim 14, wherein the plurality of transistors include:

a driving transistor driving the light emitting diode;

a sensing transistor electrically connected to the driving transistor; and a switching transistor connected to one of the plurality of data lines, and wherein the trimmed first output voltage is provided to the sensing transistor, and wherein the trimmed second output voltage is provided to the switching transistor.

16. An electronic device comprising:

a display panel including a plurality of scan lines, a plurality of data lines, and a plurality of pixels, and configured to display an image;

a data driving circuit connected to the plurality of data lines;

a scan driving circuit connected to the plurality of scan lines;

a signal control circuit configured to receive input data and to control the display panel, the data driving circuit, and the scan driving circuit; and a power supply circuit configured to trim a plurality of output voltages driving the display panel, wherein the power supply circuit includes:

a controller configured to generate a plurality of control values based on the plurality of output voltages;

a sign determining circuit configured to determine a sign of each of the plurality of control values based on the plurality of output voltages;

a plurality of voltage generators configured to generate a trimming voltage of each of the plurality of control values based on the plurality of output voltages;

a plurality of memories configured to respectively store the plurality of control values; and a switching circuit configured to select one of the plurality of memories depending on a type of the display panel to provide a corresponding control value of the plurality of control values to the controller, and wherein each of the plurality of control values is a value for controlling the sign determining circuit and each of the plurality of voltage generators.

17. The electronic device of claim 16, wherein the trimming voltage includes a first trimming voltage, a second trimming voltage, and a third trimming voltage, and wherein the plurality of voltage generators include:

a first voltage generator configured to generate the first trimming voltage;

a second voltage generator configured to generate the second trimming voltage; and a third voltage generator configured to generate the third trimming voltage, and wherein the controller is configured to cause the power supply circuit to selectively generate at least one of the first trimming voltage of the first voltage generator, the second trimming voltage of the second voltage generator, and the third trimming voltage of the third voltage generator.

18. The electronic device of claim 17, wherein the first trimming voltage is 10 mV (millivolt), the second trimming voltage is 20 mV, and the third trimming voltage is 40 mV.

19. The electronic device of claim 16, wherein the sign determining circuit includes:

a first sign determiner configured to set a sign of the trimming voltage to a first sign; and a second sign determiner configured to set a sign of the trimming voltage to a second sign different from the first sign.

20. The electronic device of claim 16, wherein each of the plurality of control values includes values to determine whether the sign determining circuit and each of the plurality of voltage generators are turned on.

* * * * *